US010321723B2

(12) United States Patent
Kelley et al.

(10) Patent No.: US 10,321,723 B2
(45) Date of Patent: Jun. 18, 2019

(54) FREE MOTION SPORTS BRA

(71) Applicant: The North Face Apparel Corp., Wilmington, DE (US)

(72) Inventors: Jennifer Kelley, Novato, CA (US); Erin Francesca Martini-Boulware, Livemore, CA (US); Ashley Haak, Philadelphia, PA (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 15/784,640

(22) Filed: Oct. 16, 2017

(65) Prior Publication Data

US 2019/0110524 A1 Apr. 18, 2019

(51) Int. Cl.
*A41C 3/00* (2006.01)
*A41F 15/00* (2006.01)
*A41F 15/02* (2006.01)

(52) U.S. Cl.
CPC ..... *A41C 3/0057* (2013.01); *A41F 15/00* (2013.01); *A41C 3/00* (2013.01); *A41F 15/02* (2013.01)

(58) Field of Classification Search
CPC ..... A41C 3/0057; A41C 3/00
USPC ..... 450/86
See application file for complete search history.

(56) References Cited

U.S. PATENT DOCUMENTS 525,241 A * 8/1894 Tucek ..... A41C 3/00 450/86
3,071,140 A * 1/1963 Adler ..... A41C 3/00 450/86
3,120,848 A * 2/1964 Seperack ..... A41C 3/00 2/73
3,186,412 A * 6/1965 Kurland ..... A41C 3/00 2/323
3,220,415 A * 11/1965 Marino ..... A41C 3/00 450/65
3,465,754 A * 9/1969 Lockwood ..... A41C 3/00 450/1
4,174,717 A * 11/1979 Schreiber ..... A41C 3/0057 450/70
4,220,157 A * 9/1980 Clark ..... A41C 3/0021 450/86
4,311,150 A * 1/1982 Schreiber ..... A41C 3/0057 450/70
4,583,544 A 4/1986 Flanagan et al.
(Continued)

FOREIGN PATENT DOCUMENTS

WO 99/53781 A1 10/1999

*Primary Examiner* — Gloria M Hale
(74) *Attorney, Agent, or Firm* — Smith, Gambrell & Russell LLP

(57) ABSTRACT

Article, such as sports bras, and methods of making the same are described. A sports bra may comprise a front panel comprising a bust panel, a first shoulder strap, and a second shoulder strap. The sports bra may comprise a rear panel comprising a first back strap and a second back strap. The first back strap may coupled to the first shoulder strap at a first shoulder seam and the second back strap may coupled to the second shoulder strap at a second shoulder seam. The first back strap may be coupled to the bust panel at a first side seam and the second back strap may be coupled to the bust panel at a second side seam. One or both of the back straps may have the second a curve-linear shape exhibiting a tapered width.

18 Claims, 4 Drawing Sheets

(56) References Cited

U.S. PATENT DOCUMENTS

| | | | |
|---|---|---|---|
| 4,816,005 | A | 3/1989 | Braaten |
| 6,302,761 | B1 | 10/2001 | Wrenn |
| 7,381,113 | B2 | 6/2008 | Hori |
| 2005/0255789 | A1 | 11/2005 | Gaudet et al. |

* cited by examiner

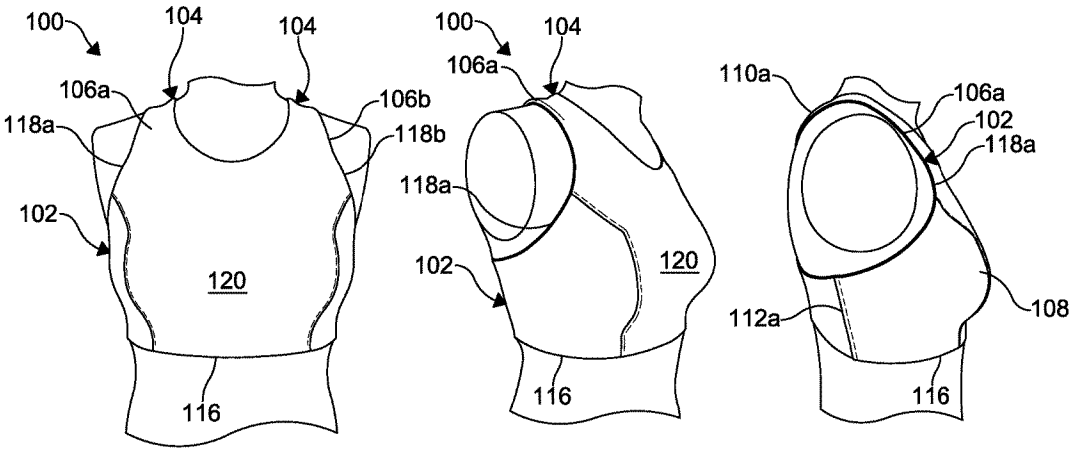
FIG. 5A
FIG. 5B
FIG. 5C
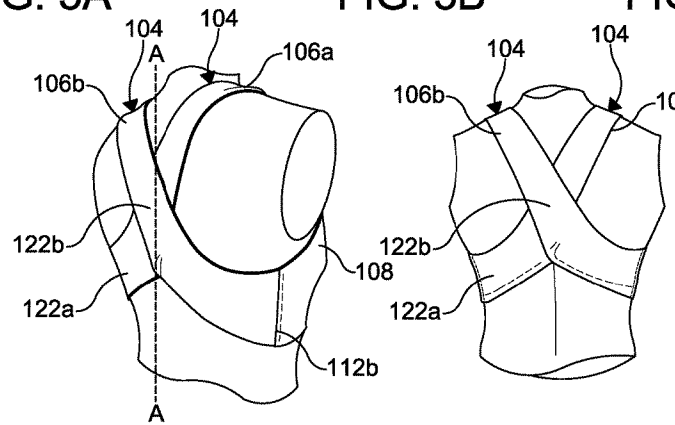
FIG. 5D
FIG. 5E

FREE MOTION SPORTS BRA

FIELD

The present disclosure relates to an article that is created to provide support for women, for example, during various activities. More particularly, a sports bra is constructed in such a manner as to provide comfort and support for the breasts and back of the wearer.

BACKGROUND

In the state of the art, various sports bras have been proposed to provide support for a wearer by including an elastic band disposed at or near the ribs of a wearer to supplement any inherent elasticity in the other portions of the sports bra. Such elastic bands may be less elastic than a material of panels forming the body of the sports bra to secure the sports bra to the torso of the wearer.

As an example, U.S. Pat. Nos. 4,174,717 and 4,311,150 to Schreiber et al. each discloses an athletic brassiere which is designed to hold the breasts snugly to the body. A wide elastic rib band and elastic strips which cross in the back hold the brassiere firmly in place.

U.S. Pat. No. 4,583,544 to Flanagan et al. describes a sports bra having an elastic band attached to the bottom of said front and rear panels and extending continuously around said brassiere.

U.S. Pat. No. 4,816,005 to Braaten describes a sports bra having a continuous bottom edge with an elastic band secured to the bottom edge and coextensive with front and rear panel sections.

U.S. Pat. No. 7,381,113 to Hori describes a sports bra having an elastic band disposed about the lower edges of an inner fabric layer and an outer fabric layer to limit the transverse movement of breast cups of the bra.

In many instances, the sports bras of the prior art including a circumferential elastic band may cause irritation or discomfort to a wearer at a region where the elastic band secures the sports bra to the wearer. As such, improvements in sports bras and other articles of clothing are needed.

SUMMARY

The present disclosure relates to articles of clothing such as bras, and in particular sports bras.

A sports bra may comprise: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer, and wherein the bust panel does not comprise a supplemental elastic circumferential band; and a rear panel comprising a first back strap and a second back strap configured in a crossback pattern, wherein the first back strap is coupled to the first shoulder strap at a first shoulder seam and the second back strap is coupled to the second shoulder strap at a second shoulder seam, wherein the first back strap is coupled to the bust panel at a first side seam, the first back strap having a curve-linear shape exhibiting a tapered width between the first side seam and the first shoulder seam, wherein the first side seam has a length that is greater than a length of the first shoulder seam, and wherein the second back strap is coupled to the bust panel at a second side seam, the second back strap having a curve-linear shape exhibiting a tapered width between the second side seam and the second shoulder seam, wherein the second side seam has a length that is greater than a length of the second shoulder seam.

An article may comprise: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured such that one of the first back strap or the second back strap overlays a portion of the other of the first back strap and the second back strap, wherein the first back strap is coupled to the first shoulder strap at a first shoulder seam and the second back strap is coupled to the second shoulder strap at a second shoulder seam, wherein the first back strap is coupled to the bust panel at a first side seam, the first side seam having a length that is greater than a length of the first shoulder seam, and wherein the second back strap is coupled to the bust panel at a second side seam, the second side seam having a length that is greater than a length of the second shoulder seam.

An article may comprise: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured in a crossback pattern, wherein the first back strap is coupled to the first shoulder strap at a first shoulder seam and the second back strap is coupled to the second shoulder strap at a second shoulder seam, wherein the first back strap is coupled to the bust panel at a first side seam, the first back strap having a curve-linear shape exhibiting a tapered width between the first side seam and the first shoulder seam, and wherein the second back strap is coupled to the bust panel at a second side seam, the second back strap having a curve-linear shape exhibiting a tapered width between the second side seam and the second shoulder seam.

There has thus been outlined, certain embodiments of the present disclosure in order that the detailed description thereof herein may be better understood, and in order that the present contribution to the art may be better appreciated. There are, of course, additional embodiments of the invention that will be described below and which will form the subject matter of the claims appended hereto.

BRIEF DESCRIPTION OF THE DRAWINGS

In order to facilitate a fuller understanding of the invention, reference is now made to the accompanying drawings, in which like elements are referenced with like numerals. These drawings should not be construed as limiting the invention and intended only to be illustrative.

FIG. 5A is a front view of a sports bra disposed on a model of a wearer in accordance with aspects of the present disclosure.

FIG. 5B is a front perspective view of the sports bra shown in FIG. 5A.

FIG. 5C is a side view of the sports bra shown in FIG. 5A.

FIG. 5D is a rear perspective view of the sports bra shown in FIG. 5A.

FIG. 5E is a rear view of the sports bra shown in FIG. 5A.

DETAILED DESCRIPTION

An article of clothing such as a bra (e.g., sports bra, everyday bra) is described.

FIGS. 1-6 illustrate an article 100 such as a bra. As shown, the article 100 may comprise a front panel comprising a bust panel, a first shoulder strap, and a second shoulder strap. The first shoulder strap and the second shoulder strap may be spaced from each other and may extend from the bust panel to define at least a portion of a neck hole configured to receive a neck of a wearer. In certain aspects, the bust panel does not comprise a supplemental elastic circumferential band, such as those used in conventional bras. A rear panel may comprise a first back strap and a second back strap configured in a crossback pattern, wherein the first back strap is coupled to the first shoulder strap at a first shoulder seam and the second back strap is coupled to the second shoulder strap at a second shoulder seam. The first back strap may be coupled to the bust panel at a first side seam. The first back strap may have a curve-linear shape exhibiting a tapered width between the first side seam and the first shoulder seam, wherein the first side seam has a length that is greater than a length of the first shoulder seam. The second back strap may be is coupled to the bust panel at a second side seam. The second back strap may have a curve-linear shape exhibiting a tapered width between the first side seam and the first shoulder seam, wherein the second side seam has a length that is greater than a length of the second shoulder seam.

Figure 1:
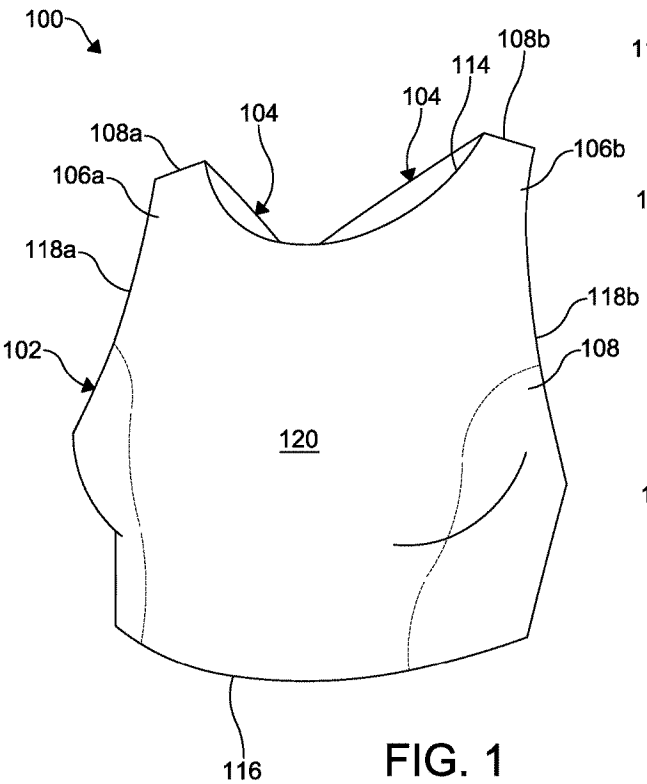
FIG. 1 is a front perspective view of a sports bra in accordance with aspects of the present disclosure.

FIG. 1 is a front perspective view of an article 100 in accordance with aspects of the present disclosure. The article may comprise a bra, such as a sports bra. The article 100 may comprise a front panel 102. The front panel 102 may comprise a bust panel 107. The bust panel 107 may not comprise (e.g., exclude) a supplemental elastic circumferential band, such as the conventional circumferential bands known in the art. The front panel 102 may comprise a first shoulder strap 106*a* and a second shoulder strap 106*b*. Each of the shoulder straps 106 may comprise a collection of straps or may be a single unitary strap. The first shoulder strap 106*a* and the second shoulder strap 106*b* may be spaced from each other. The first shoulder strap 106*a* and the second shoulder strap 106*b* may extend from the bust panel 107 to define at least a portion of a neck hole 114 configured to receive a neck of a wearer. The article 100 may comprise a bottom edge 116, such as a peripheral edge disposed opposite the neck hole 114.

Figure 2:
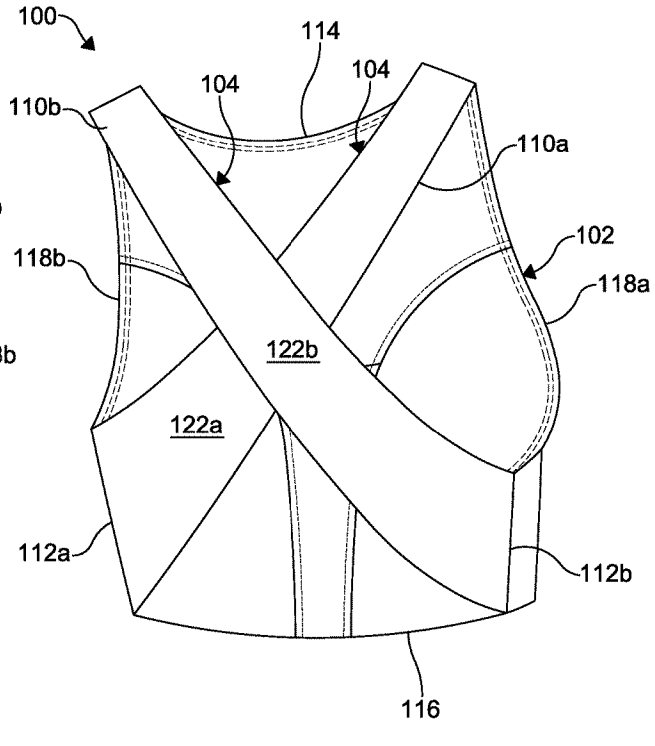
FIG. 2. is a rear perspective view of the sports bra shown in FIG. 1.

FIG. 2. is a rear perspective view of the article 100, shown in FIG. 1. The article 100 may comprise a rear panel 104. The rear panel 104 may comprise a first back strap 110*a* and a second back strap 110*b*. Each of the back straps 110 may be defined by a collection of straps or may comprise a single unitary strap. The first back strap 110*a* and the second back strap 110*b* may be configured such that one of the first back strap 110*a* or the second back strap 110 overlays a portion of the other of the first back strap 110*a* and the second back strap 110*b*. The first back strap 110*a* and the second back strap 110*b* may be configured in a crossback pattern such as shown in FIG. 2 or other crossback patterns. The first back strap 110*a* may overlay the second back strap 110*b*, thereby defining the crossback pattern.

The first back strap 110*a* may be coupled to the first shoulder strap 106*a* at a first shoulder seam 108*a*. The second back strap 110*b* may be coupled to the second shoulder strap 106*b* at a second shoulder seam 108*b*.

The article 100 may comprise one or more arm holes, such as a first arm hole 118*a* and a second arm hole 118*b*. A portion of the first back strap 110*a*, a portion of the second back strap 110*b*, and a portion of the front panel 102 may define an arm hole 118 configured to receive an arm of a wearer. For example, the first arm hole 118*a* may be defined by a top portion of the first back strap 110*a* and a bottom portion of the second back strap 110*b*. The second arm hole 118*b* may be defined by a top portion of the second back strap 110*b* and a bottom portion of the first back strap 110*a*.

The first back strap 110*a* may be coupled to the bust panel 107 at a first side seam 112*a*. The first back strap 110*a* may have a curve-linear shape. The first back strap 110*a* may have a curve-linear shape exhibiting a tapered width between the first side seam 112*a* and the first shoulder seam 108*a*. The first side seam 112*a* may have a length that is greater than a length of the first shoulder seam 108*a*. The second back strap 110*b* may be coupled to the bust panel 107 at a second side seam 112*b*. The second back strap 110*b* may have a curve-linear shape. The second back strap 110*b* may have a curve-linear shape exhibiting a tapered width between the second side seam 112*b* and the second shoulder seam 108*b*. The second side seam 112*b* may have a length that is greater than a length of the second shoulder seam 108*b*.

Figure 3:
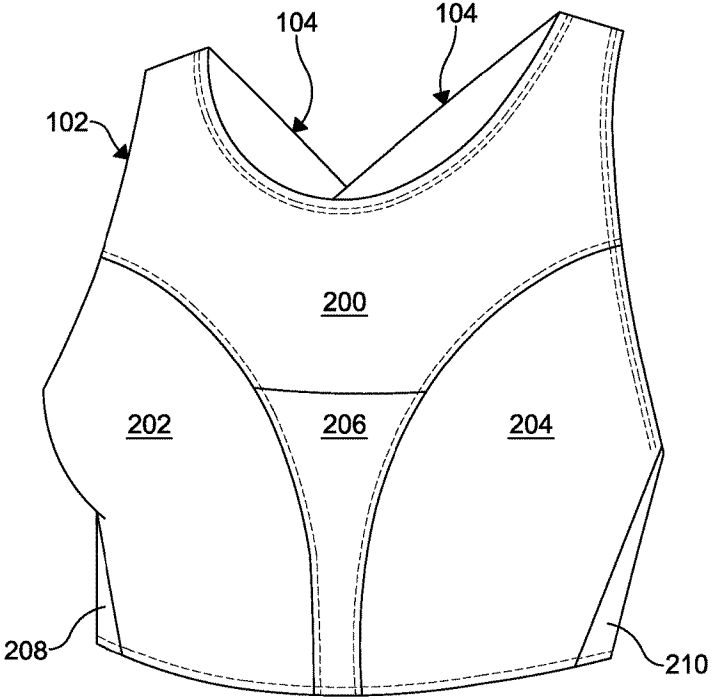
FIG. 3. is an inside front perspective view of the sports bra shown in FIG. 1, illustrating an inside surface of the sports bra.

FIG. 3. is an inside front perspective view of the article 100 shown in FIG. 1, illustrating an inside surface of the front panel 102. The article 100 may comprise a front yoke 200. The front yoke 200 may be may be defined by at least an interior portion (e.g., body facing) of the bust panel 107 (FIG. 1) and an interior portion of one or more of the shoulder straps 106 (FIG. 1). The front yoke 200 may be formed from mesh material such as a mesh liner and/or may form a multilayer structure with a material forming the bust panel 107 and/or the shoulder straps 106. The material forming the front yoke 200 may have an inherent elasticity and/or may be supplemented with one or more elastic elements such as elastic bands. As an example, elastic bands may be disposed at or near a peripheral edge of the front yoke 200.

The article 100 may comprise a first cup 202 and a second cup 204 coupled to the front yoke 200. One or more of the cups 202, 204 may be formed from a shaped foam material and may define an interior layer adjacent at least a portion of the bust panel 107 (FIG. 1). The material forming the cups 202, 204 may have an inherent elasticity and/or may be supplemented with one or more elastic elements such as elastic bands. As an example, elastic bands may be disposed at or near a peripheral edge of the cups 202, 204, such as along the bottom edge 116 or arm holes 118 (FIG. 1).

The article 100 may comprise a gore 206 coupled to the front yoke 200 and the cups 202, 204 and disposed between the first cup 202 and the second cup 204. The gore 206 may be formed from a wicking, breathable jersey material. As an example, the cups 202, 204 may be spaced form each other and the gore 206 may define the material disposed between the cups 202, 204. Various materials may be selected for wicking, moisture management, cooling, and absorbency, for example.

The article 100 may comprise a first overlay 210 and a second overlay 208. The overlays 208, 210 may be formed from various materials including a mesh material. The overlays may be formed form the same material as an interior surface of the back straps 110, as discussed herein. For example, the overlays 208, 210 may be configured to overlay at least a portion of one or more side seams 112, when viewed from an interior perspective (e.g., see FIG. 6).

Figure 4:
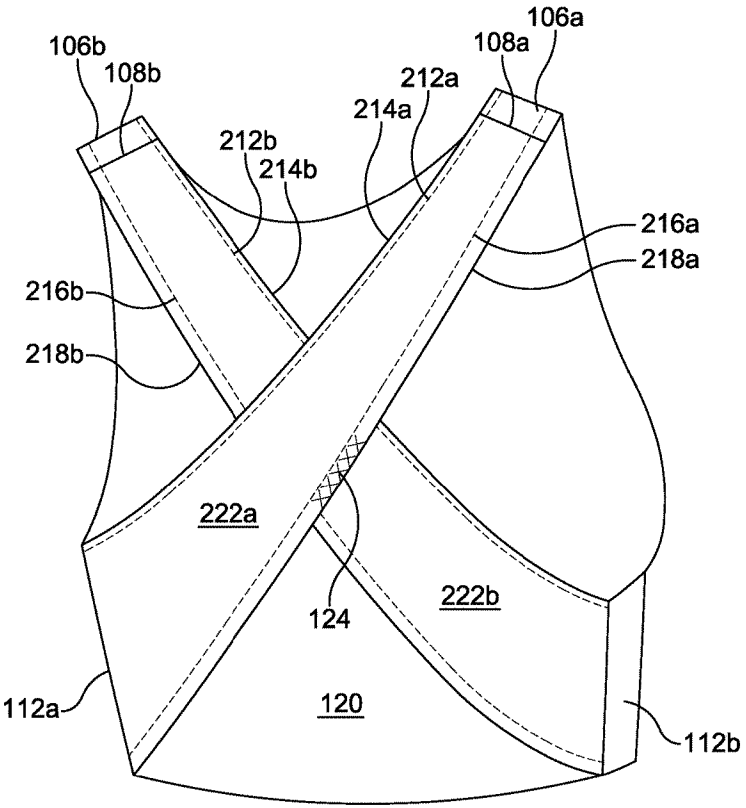
FIG. 4. is an inside rear perspective view of the sports bra shown in FIG. 1, illustrating an inside surface of the sports bra.

FIG. 4. is an inside rear perspective view of the article 100 shown in FIG. 1, illustrating an inside surface of the article 100 (e.g., sports bra). The first back strap 110*a* may be coupled the second back strap 110*b*. As shown, the first back strap 110*a* may be tacked to the second back strap 110*b*. The first back strap 110*a* may be coupled to the second back strap 110*b* using tack 124. The tack 124 may comprise a bar tack and may have a length of about ⅜". However, other couplings and lengths may be used.

The first back strap 110*a* may comprise a first inner elastic band 212*a* disposed adjacent a first inner edge 214*a*. The second back strap 110*b* may comprise a second inner elastic band 212*b* disposed adjacent a second inner edge 214*b*. The first back strap 110*a* may comprise a first outer elastic band 216*a* disposed adjacent a first outer edge 218*a*. The first back strap 110*a* may comprise a second outer elastic band 216*b* disposed adjacent a first outer edge 218*b*. The first back strap 110*a* may comprise a first interior surface 222*a*. The second back strap 112*b* may comprise a second interior surface 222*b*. The first interior surface 222*a* and the second interior surface 222*b*. One or more of the elastic bands may be formed as provide structure to the respective seam or edge and to hold the respective seam or edge in or near a position.

FIG. 5A-5E illustrate a variety of perspective views of the article 100. FIG. 5A is a front view of a sports bra disposed on a model of a wearer in accordance with aspects of the present disclosure. FIG. 5B is a front perspective view of the article 100 (e.g., sports bra) shown in FIG. 5A. FIG. 5C is a side view of the article 100 (e.g., sports bra) shown in FIG. 5A. FIG. 5D is a rear perspective view of the article 100 (e.g., sports bra) shown in FIG. 5A. FIG. 5E is a rear view of the article 100 (e.g., sports bra) shown in FIG. 5A.

As shown in FIG. 5D, the front panel 102 and the rear panel 104 may be configured such that one or more of the side seams (e.g., the first side seam 112*a*, the second side seam 112*b*) are biased towards a central axis (e.g., axis A) of a back of the wearer. For example, the first side seam 112*a* and/or the second side seam 112*b* may be closer to the central axis of the back of the wear than to a center of a front of the wearer. As a further example, one or more side seams 112 may be biased toward the axis A of the wearers back by about 2" from a center side of the wearer. However, other biasing may be used.

The first back strap 110*a* may comprise a first outer layer 122*a*. The second back strap 110*b* may comprise a second outer layer 122*b*. One or both of the first outer layer 122*a* and the second outer layer 122*b* may comprise spandex (e.g., a spandex outer layer). The spandex or other material of the outer layers 122 may comprise elastane, such as from about 11% to about 12% elastane (or from 11% to 12% elastane). The article 100 may comprise a front surface 120. The front surface 120 may comprise spandex.

One or both of the first back strap 110*a* and the second back strap 110*b* may comprise a mesh liner. The mesh liner may be disposed adjacent a spandex outer layer (e.g., the first outer layer 122*a*, the second outer layer 122*b*). The mesh liner may be configured to abut a wearer. The mesh liner may comprise from about 80% to about 81% nylon. For example, the first interior surface 222*a* and/or the second interior surface 222*b* may comprise the mesh liner. The yoke 200, the first overlay 210, the second overlay 208, or a combination thereof may also comprise a mesh liner. The mesh liner may be configured to abut a wearer. The mesh liner may comprise from about 80% to about 81% nylon.

The article 100 may be manufactured in a variety of sizes. As an illustration, the length of one or both (e.g., separately) of the first side seam 112*a* and the second side seam 112*b* may be between about 4½" and about 4⅝". The length of one or both (e.g., separately) of the first shoulder seam 108*a* and the second shoulder seam 108*b* may be between about 1" and about 1.5". A ratio of the length of the first side seam 112*a* and a length of the first shoulder seam 108*a* may be about 2.5:1. A ratio of the length of the second side seam 112*b* and a length of the second shoulder seam 108*b* may be between about 2.5:1. The tack 124 (e.g., bar tack) may have a length between about ⅜" and about ½".

Figure 6:
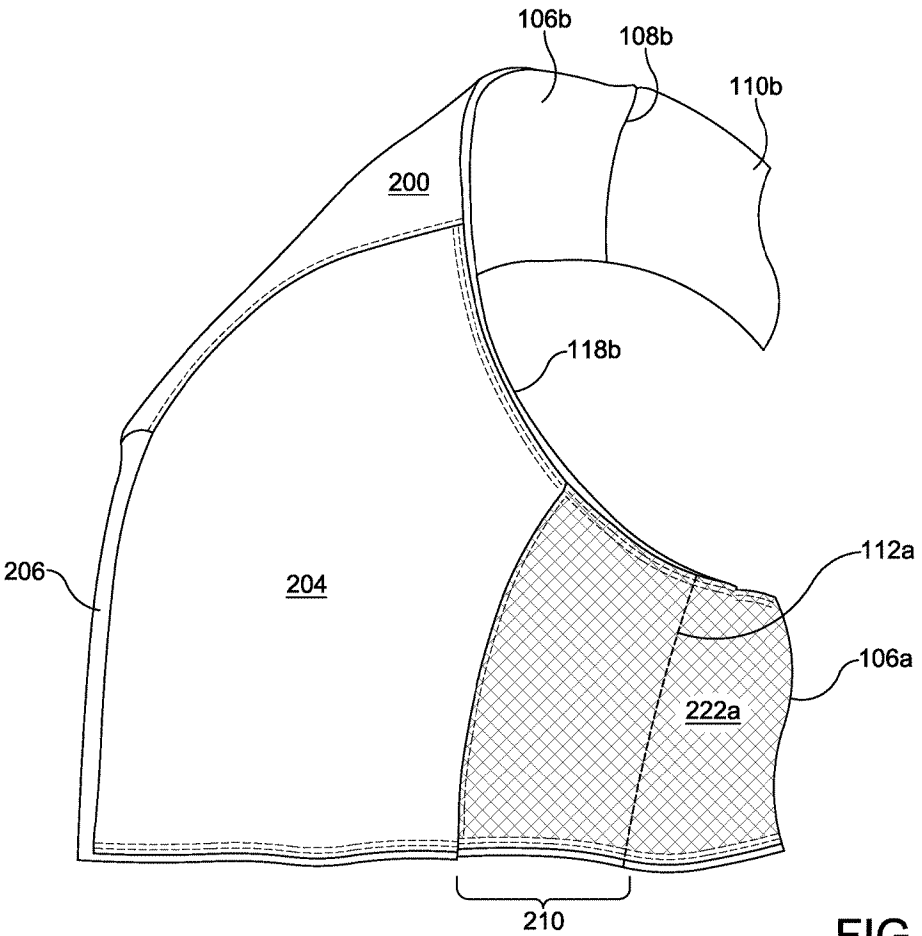
FIG. 6 is a perspective view of an inside surface of a back strap according to aspects of the present disclosure.

FIG. 6 is a perspective view of an inside surface of a back strap according to aspects of the present disclosure. FIG. 6 illustrates a closer view of an example overlay, such as the first overlay 210. The first overlay 201 may be adjacent to the (e.g., or coupled to) the second cup 204. One or both of the first side seam 112*a* and the second side seam 112*b* may be overlaid by a mesh material coupled to a corresponding one of the first back strap 110*a* and the second back strap 110*b*. The mesh material may comprise from about 80% to about 81% nylon.

In this respect, before explaining at least one embodiment of the invention in detail, it is to be understood that the invention is not limited in its application to the details of construction and to the arrangements of the components set forth in the following description or illustrated in the drawings. The invention is capable of embodiments or embodiments in addition to those described and of being practiced and carried out in various ways. Also, it is to be understood that the phraseology and terminology employed herein, as well as the abstract, are for the purpose of description and should not be regarded as limiting.

Reference in this application to "one embodiment," "an embodiment," "one or more embodiments," "aspects," or the like means that a particular feature, structure, or characteristic described in connection with the embodiment is included in at least one embodiment of the disclosure. The appearances of, for example, the phrases "an embodiment" in various places in the specification are not necessarily all referring to the same embodiment, nor are separate or alternative embodiments mutually exclusive of other embodiments. Moreover, various features are described which may be exhibited by some embodiments and not by the other. Similarly, various requirements are described which may be requirements for some embodiments but not by other embodiments.

The following exemplary embodiments are provided so that the present disclosure will be thorough and fully convey the scope to those skilled in the art. Numerous specific details are set forth such as examples of specific components, devices and schematic configurations to provide a thorough understanding of exemplary embodiments of the present disclosure. However, it will be apparent to those skilled in the art that these specific details need not be employed, that the exemplary embodiments may be embodied in many different forms, and that neither should be construed to limit the scope of the present disclosure.

In various aspects, the present disclosure may pertain to one or more of the following examples.

Example 1

A sports bra comprising: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer, and wherein the bust panel does not comprise a supplemental elastic circumferential band; and a rear panel comprising a first back strap and a second back strap configured in a crossback pattern, wherein the first back strap is coupled to the first shoulder strap at a first shoulder seam and the second back strap is coupled to the second shoulder strap at a second shoulder seam, wherein the first back strap is coupled to the bust panel at a first side seam, the first back strap having a curve-linear shape exhibiting a tapered width between the first side seam and the first shoulder seam, wherein the first side seam has a length that is greater than a length of the first shoulder seam, and wherein the second back strap is coupled to the bust panel at a second side seam, the second back strap having a curve-linear shape exhibiting a tapered width between the second side seam and the second shoulder seam, wherein the second side seam has a length that is greater than a length of the second shoulder seam.

Example 2

An article comprising: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured such that one of the first back strap or the second back strap overlays a portion of the other of the first back strap and the second back strap, wherein the first back strap is coupled to the first shoulder strap at a first shoulder seam and the second back strap is coupled to the second shoulder strap at a second shoulder seam, wherein the first back strap is coupled to the bust panel at a first side seam, the first side seam having a length that is greater than a length of the first shoulder seam, and wherein the second back strap is coupled to the bust panel at a second side seam, the second side seam having a length that is greater than a length of the second shoulder seam.

Example 3

The article of Example 2, wherein the first back strap is tacked to the second back strap.

Example 4

The article of Example 2, wherein the first back strap is coupled to the second back strap using a bar tack, and therein the bar tack has a length between ⅜" and ½".

Example 5

The article of any one of examples 2-4, wherein the front panel and the rear panel are configured such that one or more of the side seams are biased towards a central axis of a back of the wearer.

Example 6

The article of any one of examples 2-5, wherein the bust panel does not comprise a supplemental elastic circumferential band.

Example 7

The article of any one of examples 2-6, wherein a portion of the first back strap, a portion of the second back strap, and a portion of the front panel define an arm hole configured to receive an arm of a wearer.

Example 8

The article of any one of examples 2-7, wherein the length of one or both of the first side seam and the second side seam is between 4½" and 4⅝".

Example 9

The article of any one of examples 2-8, wherein the length of one or both of the first shoulder seam and the second shoulder seam is between 1" and 1.5".

Example 10

The article of any one of examples 2-9, wherein a ratio of the length of the first side seam and a length of the first shoulder seam is about 2.5:1

Example 11

The article of any one of examples 2-10, wherein a ratio of the length of the second side seam and a length of the second shoulder seam is about 2.5:1.

Example 12

The article of any one of examples 2-11, wherein the front panel is at least partially formed from a foam.

Example 13

The article of any one of examples 2-12, wherein one or both of the first back strap and the second back strap comprises an outer layer (e.g., spandex or elastane) and a mesh liner disposed adjacent the outer layer and configured to abut a wearer.

Example 14

The article of example 13, wherein the outer layer comprises from 11% to about 12% elastane.

Example 15

The article of example 13, wherein the mesh liner comprises from 80% to 81% nylon.

Example 16

The article of any one of examples 2-15, wherein one or both of the first back strap and the second back strap has a curve-linear shape.

Example 17

The article of any one of examples 2-16, wherein one or both of the first side seam and the second side seam is overlaid by a mesh material coupled to a corresponding one of the first back strap and the second back strap.

Example 18

An article comprising: a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured in a crossback pattern, wherein the first back strap is coupled to the first shoulder strap at a first shoulder seam and the second back strap is coupled to the second shoulder strap at a second shoulder seam, wherein the first back strap is coupled to the bust panel at a first side seam, the first back strap having a curve-linear shape exhibiting a tapered width between the first side seam and the first shoulder seam, and wherein the second back strap is coupled to the bust panel at a second side seam, the second back strap having a curve-linear shape exhibiting a tapered width between the second side seam and the second shoulder seam.

Example 19

The article of example 18, wherein the first back strap overlays at least a portion of the second back strap, thereby defining the crossback pattern.

Example 20

The article of any one of examples 18-19, wherein the first back strap is tacked to the second back strap.

Example 21

The article of any one of examples 18-19, wherein the first back strap is coupled to the second back strap using a bar tack, and therein the bar tack has a length between ⅜" and ½".

Example 22

The article of any one of examples 18-21, wherein the front panel and the rear panel are configured such that one or more of the side seams are biased towards a central axis of a back of the wearer.

Example 23

The article of any one of examples 18-22, wherein the bust panel does not comprise a supplemental elastic circumferential band.

Example 24

The article of any one of examples 18-23, wherein a portion of the first back strap, a portion of the second back strap, and a portion of the front panel define an arm hole configured to receive an arm of a wearer.

Example 25

The article of any one of examples 18-24, wherein the length of one or both of the first side seam and the second side seam is between 4½" and 4⅝".

Example 26

The article of any one of examples 18-25, wherein the length of one or both of the first shoulder seam and the second shoulder seam is between 1" and 1.5".

Example 27

The article of any one of examples 18-26, wherein a ratio of the length of the first side seam and a length of the first shoulder seam is about 2.5:1.

Example 28

The article of any one of examples 18-27, wherein a ratio of the length of the second side seam and a length of the second shoulder seam is about 2.5:1

Example 29

The article of any one of examples 18-28, wherein the front panel is at least partially formed from a foam.

Example 30

The article of any one of examples 18-29, wherein one or both of the first back strap and the second back strap comprises an outer layer (e.g., spandex or elastane) and a mesh liner disposed adjacent the outer layer and configured to abut a wearer.

Example 31

The article of example 30, wherein the outer layer comprises from 11% to 12% elastane.

Example 32

The article of example 30, wherein the mesh liner comprises from 80% to 81% nylon.

While the system and method have been described in terms of what are presently considered to be specific embodiments, the disclosure need not be limited to the disclosed embodiments. It is intended to cover various modifications and similar arrangements included within the spirit and scope of the claims, the scope of which should be accorded the broadest interpretation so as to encompass all such modifications and similar structures.

What is claimed is:

1. An article comprising:

a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured such that one of the first back strap or the second back strap overlays a portion of the other of the first back strap and the second back strap, wherein the first back strap is coupled to the first shoulder strap at a first shoulder seam and the second back strap is coupled to the second shoulder strap at a second shoulder seam, wherein the first back strap is coupled to the bust panel at a first side seam, the first side seam having a length that is greater than a length of the first shoulder seam, wherein the second back strap is coupled to the bust panel at a second side seam, the second side seam having a length that is greater than a length of the second shoulder seam, and wherein one or both of the first back strap and the second back strap comprises an outer layer and a mesh liner disposed adjacent the outer layer and configured to abut a wearer, and wherein the outer layer comprises from about 11% to about 12% elastane.

2. The article of claim 1, wherein the first back strap is coupled to the second back strap using a bar tack, and wherein the bar tack has a length between ⅜" and ½".

3. The article of claim 1, wherein the front panel and the rear panel are configured such that one or more of the side seams are biased towards a central axis of a back of the wearer.

4. The article of claim 1, wherein the bust panel does not comprise a supplemental elastic circumferential band.

5. The article of claim 1, wherein a portion of the first back strap, a portion of the second back strap, and a portion of the front panel define an arm hole configured to receive an arm of a wearer.

6. The article of claim 1, wherein the length of one or both of the first side seam and the second side seam is between 4½" and 4⅝".

7. The article of claim 1, wherein the length of one or both of the first shoulder seam and the second shoulder seam is between 1" and 1.5".

8. The article of claim 1, wherein a ratio of the length of the first side seam and a length of the first shoulder seam is about 2.5:1 and wherein a ratio of the length of the second side seam and a length of the second shoulder seam is about 2.5:1.

9. The article of claim 1, wherein the mesh liner comprises from 80% to 81% nylon.

10. The article of claim 1, wherein one or both of the first back strap and the second back strap has a curve-linear shape.

11. The article of claim 1, wherein one or both of the first side seam and the second side seam is overlaid by a mesh material coupled to a corresponding one of the first back strap and the second back strap.

12. An article comprising:

a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured in a crossback pattern, wherein the first back strap is coupled to the first shoulder strap at a first shoulder seam and the second back strap is coupled to the second shoulder strap at a second shoulder seam, wherein the first back strap is coupled to the bust panel at a first side seam, the first back strap having a curve-linear shape exhibiting a tapered width between the first side seam and the first shoulder seam, wherein the second back strap is coupled to the bust panel at a second side seam, the second back strap having a curve-linear shape exhibiting a tapered width between the second side seam and the second shoulder seam, and wherein one or both of the first back strap and the second back strap comprises an outer layer and a mesh liner disposed adjacent the outer layer and configured to abut a wearer.

13. The article of claim 12, wherein the first back strap overlays at least a portion of the second back strap, thereby defining the crossback pattern.

14. The article of claim 12, wherein the first back strap is coupled to the second back strap using a bar tack, and therein the bar tack has a length between ⅜" and ½".

15. The article of claim 12, wherein the front panel and the rear panel are configured such that one or more of the side seams are biased towards a central axis of a back of the wearer.

16. The article of claim 12, wherein the bust panel does not comprise a supplemental elastic circumferential band.

17. The article of claim 12, wherein a portion of the first back strap, a portion of the second back strap, and a portion of the front panel define an arm hole configured to receive an arm of a wearer.

18. An article comprising:

a front panel comprising a bust panel, a first shoulder strap, and a second shoulder strap, wherein the first shoulder strap and the second shoulder strap are spaced from each other and extend from the bust panel to define at least a portion of a neck hole configured to receive a neck of a wearer; and a rear panel comprising a first back strap and a second back strap configured such that one of the first back strap or the second back strap overlays a portion of the other of the first back strap and the second back strap, wherein the first back strap is coupled to the first shoulder strap at a first shoulder seam and the second back strap is coupled to the second shoulder strap at a second shoulder seam, wherein the first back strap is coupled to the bust panel at a first side seam, the first side seam having a length that is greater than a length of the first shoulder seam, wherein the second back strap is coupled to the bust panel at a second side seam, the second side seam having a length that is greater than a length of the second shoulder seam, and wherein one or both of the first side seam and the second side seam is overlaid by a mesh material coupled to a corresponding one of the first back strap and the second back strap.

* * * * *